United States Patent [19]

Finch et al.

[11] 4,234,220

[45] Nov. 18, 1980

[54] EXTERIOR SAFETY LOCK APPARATUS

[76] Inventors: Harry E. Finch, 5273 Vista del Sol; Geza J. Szayer, 5335 Canterbury St., both of Cypress, Calif. 90630

[21] Appl. No.: 916,553

[22] Filed: Jun. 19, 1978

[51] Int. Cl.[3] ..... E05C 1/04; E05C 13/02; E05B 65/06

[52] U.S. Cl. ..... 292/148; 70/39; 70/128; 70/134

[58] Field of Search ..... 292/148, 57, 60, 62; 70/128, 133, 134, 129, 2, 6, 11, 32, 39

[56] References Cited

U.S. PATENT DOCUMENTS

| | | | |
|---|---|---|---|
| 1,866,955 | 7/1932 | Terrill | 70/6 |
| 2,656,704 | 10/1953 | Mancuso | 70/128 |
| 2,758,861 | 8/1956 | Molloy | 292/57 |
| 3,945,228 | 3/1976 | Voegeli | 70/39 X |
| 3,946,581 | 3/1976 | Weeks et al. | 70/6 |
| 3,953,062 | 4/1976 | Maston | 292/57 |
| 4,095,828 | 6/1978 | East | 292/148 |

FOREIGN PATENT DOCUMENTS

| | | | |
|---|---|---|---|
| 1068430 | 2/1954 | France | 292/57 |
| 1306055 | 9/1962 | France | 292/57 |

*Primary Examiner*—William E. Lyddane
*Attorney, Agent, or Firm*—Henry M. Bissell

[57] ABSTRACT

Tamper-free exterior lock apparatus to affix to a door for maintaining latched engagement to the door's frame. Two sets of shackles, one pair fixed to a backing plate and the other insertable with respect to a lock housing, engage, respectively, a primary lock and a secondary lock so that no portion of the shackle is exposed when coupled with its lock. Primary lock guards protrude from the lock housing to restrict access to the primary lock. A slide bar having a latching portion at one end and a lip portion oriented perpendicular to the main portion of the slide bar at the other end is maintained in slidable relationship to the backing plate and housing to allow the movement of the lock apparatus from its latching position to its open position and to block the slide bar from movement when either or both of said locks is engaged to its set of shackles.

25 Claims, 5 Drawing Figures

EXTERIOR SAFETY LOCK APPARATUS

BACKGROUND OF THE INVENTION

1. Field of the Invention

This invention relates to door latching apparatus and, in particular, to tamper-proof lock apparatus for application to the exterior portion of a door.

2. Description of the Prior Art

Frequently, the integrity of door locking methods and apparatus is compromised by the necessity of providing exterior access to the lock. This is common to most lock uses, although various schemes have been employed to minimize the exposure of vulnerable lock portions to a would-be tamperer. Wooden doors having significant depth are commonly employed in residential dwellings. This allows the recessing of the door lock well into the door. An intruder is left only with the relatively flush face of the lock in any attempt to disable its mechanism. These recessed locks are fairly effective against all but the most sophisticated and generally must be "picked" to be overcome. Additionally, residential applications are aided by the fact that, in a well-populated area, it would be unseemly and, therefore unlikely, for an intruder to take the extensive measures required to separate such a well-anchored lock from the door.

Non-residential uses such as warehouses and businesses face tampering problems much more severe than residences. These applications are frequently located in areas that are relatively unpopulated during the night. Security guard services, to be effective, involve considerable expense in view of large areas of vulnerability which must be canvassed in regard to any large warehouse. Often it is expensive and impractical to provide a door of sufficient depth to anchor and conceal a lock. (This problem is also encountered in residence garages.) The advent of "mini-warehouses", a boon to the storage of the entire spectrum of manufactured goods and the like, comprise, generally, pre-fabricated walls and metallic roll-down doors of sheet metal of minimal thickness. The metal door is often corrugated. These warehouses commonly employ an exteriorly mounted latching mechanism which includes mating parts which are secured in latching position by the use of a standard padlock.

The padlocks employed in present-day latching mechanisms are often vulnerable to tampering on two counts. A padlock commonly comprises a relatively sturdy body which is engageable to a U-shaped shackle portion. The shackle is generally tubular throughout its U-shape. A standard hacksaw or bolt cutter is generally capable of severing the shackle, allowing the latching mechanism to be disengaged. An additional vulnerability of such latching mechanism is that the body of the lock may be dislodged from its shackles by the sharp blow of a hammer or other blunt instrument. Thus, the exteriorly mounted latching mechanisms of the prior art, frequently employing one or more standard padlocks, present apparatus of unacceptable vulnerability for a variety of applications.

Thus, it may be seen that a tamper-free exterior lock apparatus is desired for the latched securing of a door of the type commonly employed in warehouses, garages, etc. which is invulnerable to the type of tampering generally encountered by padlocked latching mechanisms.

SUMMARY OF THE INVENTION

In brief, arrangements in accordance with the present invention comprise a locking assembly containing padlock shackles for engagement by a padlock body of the type which is entirely removable from the shackles. This is similar to a type of bicycle padlock which has been commercially available for many years except that the lock body operates with a key rather than with a combination. The locking assembly is affixed to a door or other element which it is desired to be able to lock with a padlock in a predetermined position relative to an associated retaining member, such as may be mounted on or in an associated door frame. Although embodiments of the invention are described herein in such a context, it will be clearly understood that the arrangement may be reversed just as well; that is, the locking assembly may be attached to the door frame with the retaining member affixed to or mounted in the associated door. Arrangement is provided for the mounting of the locking assembly on the door or other member in a secure manner which precludes a would-be burglar from readily getting at and cutting the mounting fastenings. The locking assembly is also constructed with a partial enclosure or barrier about the shackle pins so that they are protected against access by bolt cutters or other cutting implements when the padlock body is in place thereon.

One particular arrangement in accordance with the present invention utilizes a backing plate having a pair of shackles fixed thereon to mate in flush engagement with a primary padlock body. A slide bar having a latching portion and a lip portion perpendicularly oriented to its major portion at opposite ends thereof is maintained in slidable relation to the backing plate and to a housing. A secondary padlock body is engageable to a second pair of removable shackles which may be inserted into the housing to provide additional retention of the slide bar in latching position. Primary lock guards at opposite sides of the channel of the housing into which the primary lock body is insertable provide protection for the primary padlock from blows of blunt instruments and the like.

Another, preferred embodiment of the present invention comprises a box having an open front for access to the shackle pins which extend through the back of the box and serve as the mounting bolts for securing to the associated door or other member. Space is provided for two pairs of shackle pins for use with primary and secondary padlock bodies as before. A box such as is employed in the preferred embodiment may be readily fashioned from a flat sheet of metal, appropriately shaped and punched with the necessary holes, and then bent and spot welded to form the shape of the box. A hole is provided in each of the opposed ends of the box for mounting a latching rod (taking the place of the slide bar of the first-mentioned embodiment) which is both slidable from side to side relative to the box and is also rotatable relative to the box about the axis of the rod. Fixedly attached to the rod, as by welding, is a generally U-shaped member referred to as a lockout element or tab. One side of the U-shaped lockout tab is provided with a projecting lip which serves as a handle portion for gripping the tab to move the rod between latched and unlatched positions. The other side of the U-shaped member has a bent-over portion shaped to fit generally the circumference of the rod along the points of attachment and also to accommodate to the interior shape and dimensions of the box so as to permit the necessary amount of rotation of the rod and attached lockout tab, thereby permitting the tab to be removed from engagement with one pair of shackle pins for shifting the rod to the other position where the tab can be moved to engage the other pair of shackle pins. The bottom portion of the U-shaped tab is provided with a pair of elongated, somewhat elliptically shaped holes which correspond in position to the location of a pair of shackle pins in the backside of the box. The elongation of these holes permits the lockout tab to be rotated with the attached slide rod about the axis of the rod without interference with the shackle pins.

Thus, when no lock bodies are mounted on the shackle pins of this locking assembly, the slide rod is movable between the latching and unlatching positions by gripping the handle portion of the lockout tab and rotating it upwardly until it no longer engages one of the pairs of shackle pins. The lockout tab is then shifted laterally to the other position in the box and rotated downwardly to engage the other pair of shackle pins. The mounting of the lockout tab on the latching rod in the manner described also serves to limit the travel of the slidable latching rod, since the opposite ends of the box bearing against the lockout tab prevent travel of the rod beyond the position of alignment of the lockout tab with one or the other pair of shackle pins. This prevents the rod from being removed from the box once the lockout tab is attached to the rod. Placement of a padlock body on either pair of shackle pins serves to prevent the movement of the lockout tab and latching rod out of the position assumed when the padlock body was put into place. Thus, this embodiment permits the locking assembly to be locked in either the latched or unlatched position and by either one of two users of the locking assembly who may have differently keyed padlock bodies. For example, in a so-called mini-warehouse facility where a small enclosed storage area is assigned to a given tenant, it is desirable for the landlord to be able to lock the facility with his own padlock in the event that the tenant gets behind on his rent. The landlord may place his own secondary padlock body on the second pair of shackle pins and thereafter, even though the tenant removes his own primary padlock body with his own key, the latching rod cannot be moved to the unlatched position with the secondary padlock body still in place. Also, it is possible to lock the assembly with the slidable latching rod in either the latched or unlatched position.

Accordingly, it is an object of the present invention to provide an exterior lock apparatus in which the shackles of the locking mechanism are not accessible to a potential tamperer when the apparatus is in its locking mode.

Another object of the present invention is to achieve the above object by apparatus which utilizes one or, for particular purposes, two standard padlock bodies, the shackles of neither of which are accessible when said apparatus is in its locking mode, with the shackles of the second padlock being removable.

Yet still another object of the present invention is to achieve the above objects by apparatus which provides protection for the primary padlock body against a blow from a blunt object or the like.

BRIEF DESCRIPTION OF THE DRAWING

A better understanding of the present invention may be had from a consideration of the following detailed description, taken in conjunction with the accompanying drawing, in which.

DESCRIPTION OF THE PREFERRED EMBODIMENTS

Figures 1, 2:
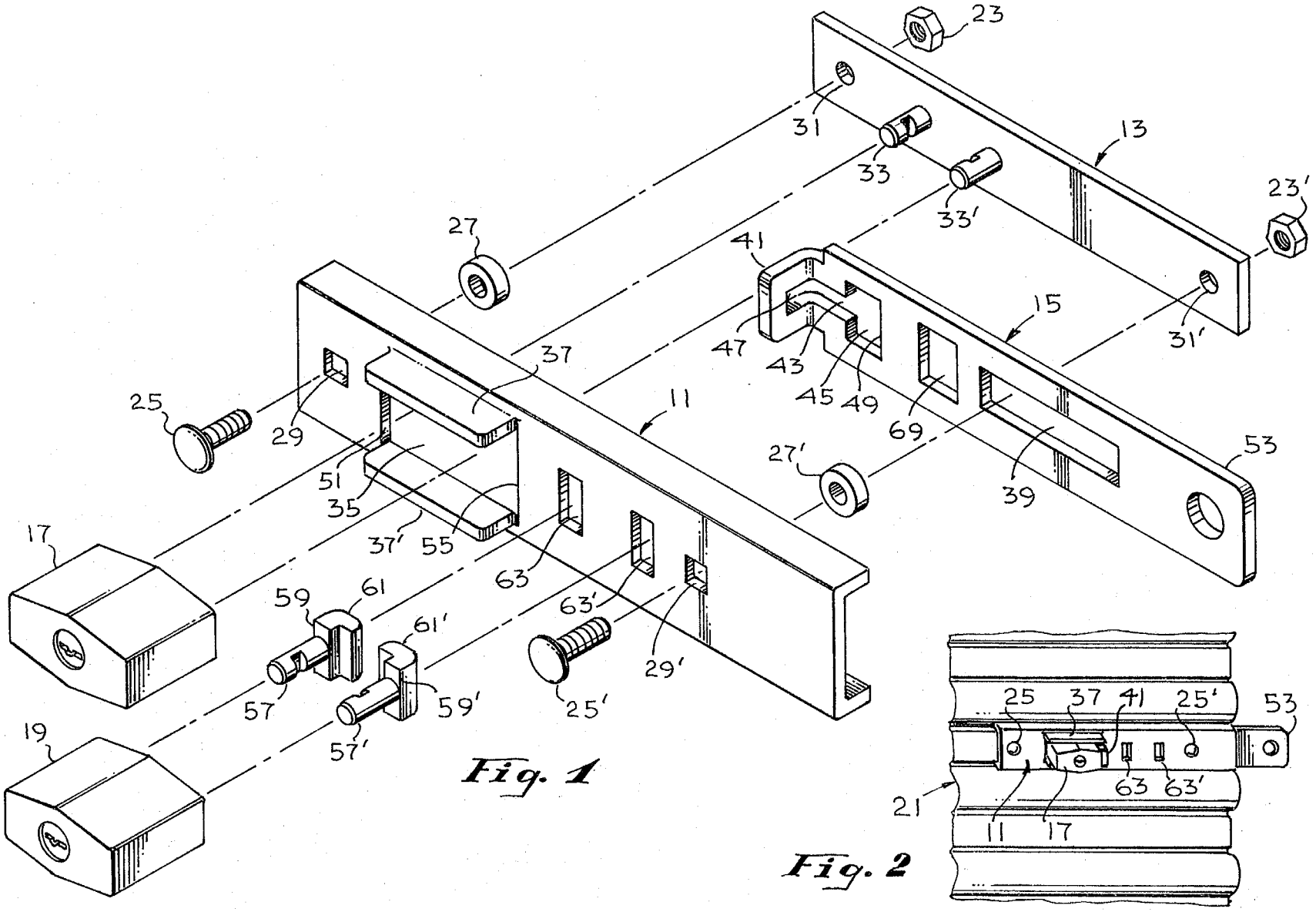
FIG. 1 is an exploded view of a preferred embodiment of the present invention.
FIG. 2 is a perspective view of the embodiment of FIG. 1 shown mounted on the exterior of a door.

FIG. 1 shows a first embodiment of the present invention in exploded view, illustrating the constituent parts thereof. The latch mechanism of the invention is seen to comprise three main elements, housing 11, backing plate 13 and slide bar 15, which, as will be seen, infra, interact with a primary lock 17 and secondary lock 19 to secure the latched position of slide bar 15. Backing plate 13 is fitted to the interior of a door 21 (see FIG. 2) by means of a pair of nuts 23, 23' which interact with bolts 25, 25'. A pair of spacers 27, 27' are inserted into a gap between the housing 11 and door 21 to reinforce the U-shaped cross-section of the housing 11 against the force imparted by the heads of bolts 25, 25' at openings 29, 29'. The bolts 25, 25' communicate with nuts 23, 23' through holes 31, 31'. As door 21 is commonly of thin cross section, it can be seen that the exterior lock apparatus of the present invention is easily and simply adapted to a door 21 with the aid of a simple drilling operation to allow passage of bolts 25, 25' and shackles 33, 33' therethrough.

Shackles 33, 33' are affixed to the backing plate 13. The shackles 33, 33' may either be welded to backing plate 13, formed therewith, or otherwise attached. They are so dimensioned and positioned on backing plate 13 as to engage corresponding insertion holes in the body of a standard padlock of the type having a lock body separable from the shackles which serves as the primary lock 17 of the present invention. The lengths of shackles 33, 33' are so chosen that, when primary lock 17 is engaged thereto, its face is sufficiently close to the backing plate 13 that, in combination with housing 11, the relatively cylindrical shackles 33, 33' are rendered inaccessible to a hacksaw or other like tool of a would-be tamperer.

Primary lock 17, when engaged to its shackles 33, 33', sits in and passes through an orifice 35 in housing 11. The orifice 35 is of sufficient size to admit the cross section of primary lock 17 for insertion, but need not be exactly so dimensioned. A pair of primary lock guards 37, 37', which may be formed with housing 21 as by stamping, are located at the "top" and "bottom" of orifice 35, corresponding to the major sides of primary lock 17. The guards 37, 37' provide additional security for the system. In addition to restricting the access to the fixed shackles 33, 33', guards 37, 37' provide protection against a blow to the lock 17 from an object such as a hammer, which might otherwise cause the lock 17 to be disengaged from shackles 33, 33'.

Slide bar 15 is seated in the longitudinal channel existing in the gap between the U-shaped cross section of housing 11 and the door 21. Spacer 27' secures the engagement of the slide bar 15 by its intersection of the slide bar at gate 39. The gate 39 is at least as wide as orifice 35. This allows the blocking lip 41 located on slide bar 15 to traverse the entire width of orifice 35. Lip 41 is perpendicularly oriented to the main body of slide bar 15. A key shaped guide 43, comprising both a block portion 45 and a slip portion 47, is positioned in the slide bar 15, spanning the blocking lip 41 and adjacent portion of slide bar 15. Slip portion 47 of lip 41 allows the slide bar to move past the fixed shackles 33, 33' of the assembled apparatus. Movement is limited by edge 49 of block portion 45 of guide 43. The guide 43 is so dimensioned that lip 41 abuts the edge 51 of orifice 35 to allow the latching portion 53 of slide bar 15 to be retracted to non-engaging position or to abut edge 55 when slide bar 15 has been shifted for engagement of the latching portion 53 with a mating piece (not shown), commonly located on the frame of door 21. The engagement of the latching portion 53 of slide bar 15 with its mating portion after the shifting of slide bar 15 to latching position is maintained by the insertion of primary lock 17, limiting the degree of freedom of slide bar 15 to the measure existing between edge 55 and inserted lock 17.

A second pair of insertable shackles 57, 57' interact with a secondary lock 19. The lengths of shackles 57, 57' are such that the secondary lock 19 will sit flush to the plateau portions 59, 59' of shackle bases 61, 61' to deny access to the shackles 57, 57' when secondary lock 19 is engaged therewith. The base portions 61, 61' of the insertable shackles 57, 57' interact with shackle slots 63, 63' to provide for their (optional) engagement to the housing 11. Their bases 61, 61', including plateau portions 59, 59', are so designed to interact with the slots 63, 63' in such a manner that, when engaged with slots 63, 63', bases 61, 61' in turn, protrude into the channel between housing 11 and door 21.

The protruding bases 61, 61' are matched, respectively, with block portion 45 of key guide 43 and guide 69 of slide bar 15. When inserted and secured by engagement to secondary lock 19, the bases 61, 61' of insertable shackles 57, 57' thus provide two blockages to movement of the latched slide bar 15 in addition to that blockage occasioned by the presence of primary lock 17 in orifice 35. The insertable shackles 57, 57' and secondary lock 19 are for the purpose of locking the facility by the landlord when the tenant, who has a key to the primary lock 17, is delinquent in payment of his rent. Thus he is unable to gain access to the facility until the landlord removes the secondary lock 19.

In FIG. 2, the present invention may be seen utilizing only primary lock 17. The optional nature of secondary lock 19 and insertable shackles 57, 57' is evident. The relatively impregnable nature of the present invention is highlighted by the unitary appearance of its lock/latch mechanisms. Unlike commonly employed warehouse latching mechanisms, the shackles of primary lock 17 do not present an exposed and vulnerable umbilicus between latch and lock.

In operation, latching portion 53 of slide bar 15 is moved to engagement with a mating piece mounted on the door frame (not shown) by manual operation of blocking lip 41. With lip 41 shifted to contact edge 55 of orifice 35, primary lock 17 is inserted into the orifice 35 to be secured to fixed shackles 33, 33'. The door 21 is now "locked", the slide bar 15 maintained securely between edge 55 and the side of primary lock 17. For locking by the secondary lock 19, insertable shackles 57, 57' are engaged to housing 11. This is accomplished by the operator holding an insertable shackle 57 approximately parallel to the face of housing 11 at its cylindrical (non-base) portion. The edge of base 61 may then be matched with slot 63 and inserted therein. The operator then moves the cylindrical (non-base) portion to a position perpendicular to the base of housing 11, causing the shackles 57 to snap into place. The process may be repeated to snap shackle 57' into slot 63'. Secondary lock 19 is next caused to engage the now-inserted shackles 57, 57'. The bases 61, 61' now are secured as obstacles to the movement of slide bar 15 within the channel existing between door 21 and housing 11 at block portion 45 of key shaped guide 43 and at guide 69, even though the primary lock 17 may be removed. The door 21 may be unlatched by reversing the above. That is, secondary lock 19 is removed from shackles 57, 57' and the insertable shackles 57, 57' removed by a reversal of the manual process above-described. Thereafter the primary lock 17 is removed. Finally, the operator manually, using blocking lip 41 as a handle, may now cause slide bar 15 to be shifted toward edge 51, retracting latching portion 53 from the mating piece (not shown) and unlatching door 21 from its frame. It may be noted that a secure latching relationship may be maintained by use of either primary lock 17 or secondary lock 19 and its associated shackles 57, 57'. Thus, use of either lock is independent of the other insofar as locking the door is concerned.

Figure 3:
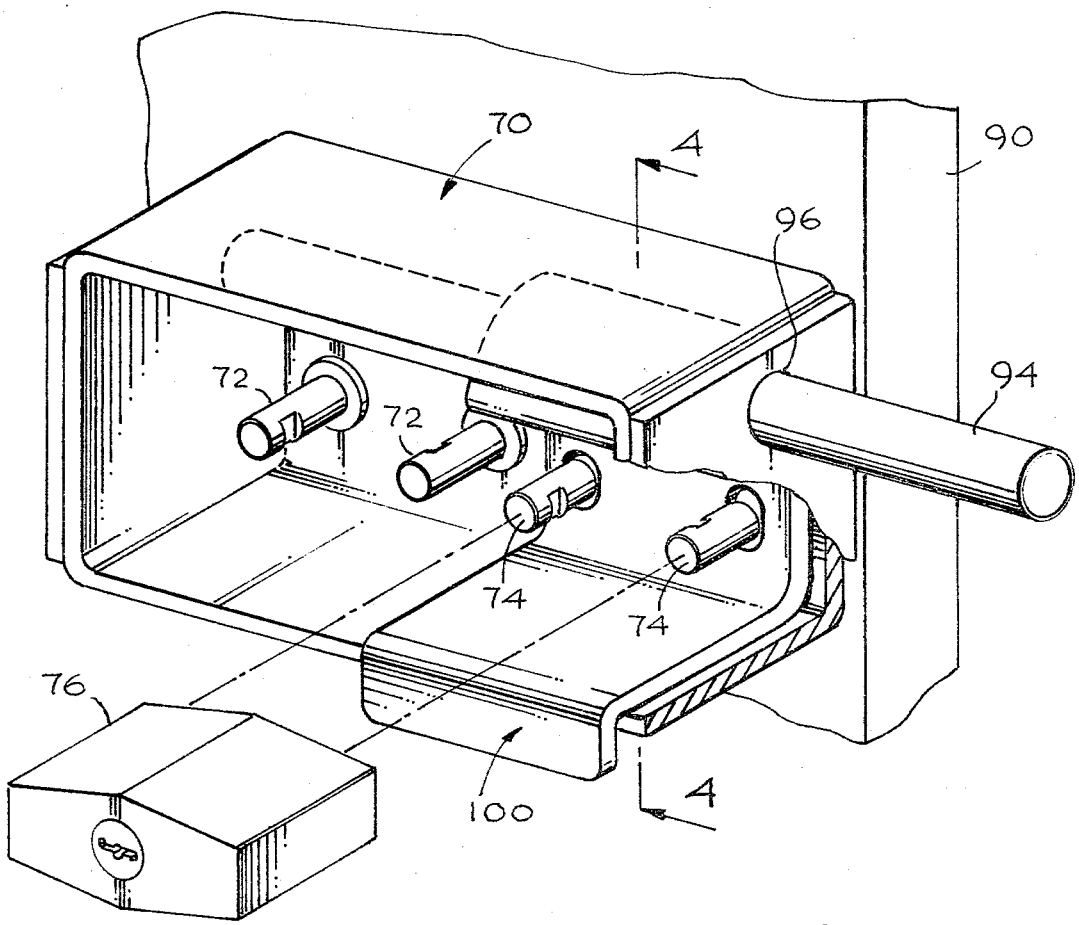
FIG. 3 is a perspective view, partially broken away, of an alternative arrangement in accordance with the present invention.
Figure 4:
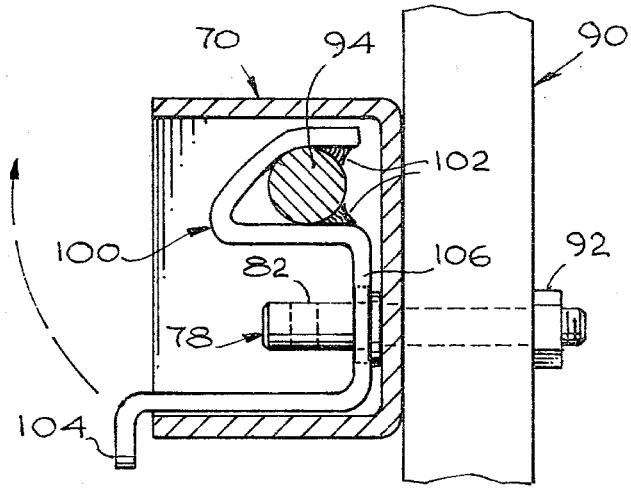
FIG. 4 is a sectional view, taken along the line 4—4 of FIG. 3.
Figure 5:
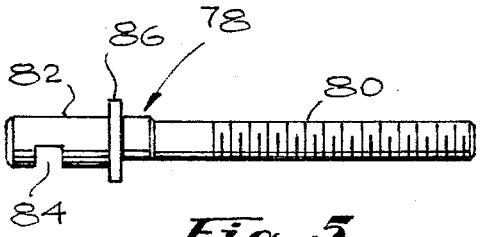
FIG. 5 is an elevational view of a shackle pin employed in the arrangement of FIG. 3.

A second, preferred embodiment of the invention is shown in FIGS. 3–5 as comprising a box 70 having an open front and two pairs of shackle pins 72, 74 mounted through holes at the back of the box 70, positioned and spaced appropriately to receive a padlock body 76. The shackle pins 72, 74 are of the type shown in FIG. 5 and designated 78. Each has a threaded portion 80 and a shackle portion 82 with a notch 84 adapted to engage a retainer member (not shown) within the padlock body 76. Between the threaded portion 80 and the shackle portion 82 of the shackle pin 78 is a shoulder portion 86 of extended diameter for retaining the rear wall of the box 70 when the shackle pin is extended through a door panel 90 or the like and held in place by a nut 92 or other retaining member (see FIG. 4). When mounted in this fashion, the shackle pins such as 78 serve to affix the box 70 with the latching mechanism therein in place on the door or other member 90 so that the locking assembly cannot be removed from outside. At the same time the shackle portion 82 extends into the box 70 from the rear wall thereof for engagement by an associated lock body 76. The lock assembly also includes a slidable latching rod 94 which is shown in FIG. 3 extending outwardly from the right through a hole 96 in the right-hand end of the box 70. The rod 94 also extends through the box 70 and through a similar hole in the left-hand end of the box. When the padlock bodies 76 are removed from the shackle pins 72, 74, the latching rod 94 may be moved to the left or to the right within the box 70 between unlatched and latched positions, corresponding to the left-hand shackle pins 72 and the right-hand shackle pins 74, respectively.

A lockout tab 100 is attached to the rod 94, preferably by welds 102. The lockout tab 100 is provided with a projecting lip 104 for ease in grasping the tab 100. The tab 100 is also shaped to embrace the rod 94 and to permit rotation therewith within the box through a limited angle of approximately 45°. This permissible angle of rotation of the lockout tab 100 and latching rod 94 is sufficient to permit the bottom portion 106 of the tab 100 to clear the outer end of the shackle pins so that the combination of the lockout tab 100 and the latching rod 94 may be shifted laterally between latched and unlatched positions of engagement with one or the other of the pairs of shackle pins 72, 74.

In operation of the embodiments of FIGS. 3–5, when the lockout tab 100 is in position over one of the pairs of shackle pins 72, 74 (say the pair 74 as shown in FIG. 3) a padlock body such as 76 (used as either the primary or secondary padlock body as described in connection with the first embodiment hereinabove) may be placed in engagement over either pair of shackle pins. A padlock body such as 76 in either position—engaging the shackle pins 72 or the shackle pins 74—will prevent the locking assembly of FIGS. 3–5 from being unlocked by blocking lateral movement of the lockout tab 100 and the slidable latching rod 94 beyond the position shown in FIG. 3. Similarly, were the lockout tab 100 moved to the left-hand position to be engaged by the shackle pins 72, positioning a padlock body over the right-hand shackle pins 74 would prevent the lock assembly of FIGS. 3–5 from being changed to the latching position, since the padlock body 76 would block movement of the lockout tab 100 and associated slidable latching rod 94 to the latching position. This latter circumstance would be desirable in the case of a garage door under the control of a motorized operator or garage door opener, since it would be desirable to keep the door from being latched and thus preventing the motorized operator from either opening or closing the door.

With the particular arrangements of the present invention as shown and described herein, a simple but effective locking assembly is provided which is usable with commercially available padlocks of a particular design in a manner which prevents access to the padlock shackles by a bolt cutter, saw or similar device, thus preventing easy entrance by a burglar to a padlocked facility. These arrangements also, by virtue of their construction, limit access to the padlock body by a sledge hammer or similar implement, thus making it more difficult for a would be burglar to knock the padlock body off the shackles. Moreover, a double padlocking arrangement is provided which may be utilized, if desired, in a way which requires two different keys (presumably in the respective custody of two different individuals) to be inserted into the padlocks utilized with the locking assembly before the locking assembly can be changed between latched and unlatched positions. The arrangements in accordance with the present invention as disclosed are readily attachable to the door of a building, for example, in simple, economical fashion but in a manner which renders the facility reasonably secure against unwarranted access. The disclosed arrangements in accordance with the present invention are reliable, effective, maintenance free, economical to manufacture and simple to use. They serve a need which is becoming more urgent with the trend in crime statistics, particularly in metropolitan areas, which need has not been met by any known comparable arrangement in the prior art.

Although there have been described hereinabove specific arrangements of exterior safety lock apparatus in which the invention may be used to advantage, it will be appreciated that the invention is not limited thereto. Accordingly, any and all modifications, variations or equivalent arrangements which may occur to those skilled in the art should be considered to be within the scope of the invention as defined in the appended claims.

What is claimed is:

1. A locking assembly for mounting on one of a pair of members to be latched together, comprising:

a housing;

a slidable latch supported by and movable relative to the housing between latched and unlatched positions;

a first pair of shackle pins;

means for mounting said first pair of shackle pins within said housing for engaging a removable padlock body when positioned thereon; and a lockout tab affixed to the slidable latch for movement therewith, said lockout tab serving to block movement of the latch in either direction between said latched and unlatched positions when a padlock body is in position to engage the shackle pins.

2. The assembly of claim 1 wherein the shackle pin mounting means is recessed relative to the housing to prevent access to the shackle pins when a padlock body is attached thereto.

3. The assembly of claim 1 further comprising a second pair of shackle pins and means for mounting said second pair of shackle pins for retaining a second padlock body in locking position thereon, said lockout tab serving to block movement of the latch in either direction between said latched and unlatched positions when either padlock body is in position to engage its corresponding shackle pins, independently of the presence or absence of the other padlock body.

4. The assembly of claim 3 wherein the second shackle pin mounting means is aligned adjacent the first shackle pin mounting means in a recessed position within the housing.

5. The assembly of claim 3 wherein the lockout tab is so configured as to prevent lateral movement of the slidable latch when a padlock body is in position on either pair of shackle pins.

6. The assembly of claim 3 wherein the second shackle pin mounting means comprises a portion of the housing and the first shackle pin mounting means comprises a bar adapted for mounting within the housing.

7. The assembly of claim 6 further comprising a pair of mounting bolts for securing the housing and the shackle pin mounting bar together and to an associated member to be latched, the latch being adapted to encompass at least one of said mounting bolts by means configured to permit lateral movement of the latch relative to the housing and said at least one mounting bolt.

8. The assembly of claim 3 wherein the second pair of shackle pins are configured to be releasably inserted into corresponding apertures in said housing, the configuration of the second pair of shackle pins being such that the pins are retained by the housing when a padlock body is positioned on the shackle pins.

9. The assembly of claim 8 wherein the configuration of said second pair of shackle pins includes means for blocking movement of the latch out of the latched position.

10. The assembly of claim 1 wherein each shackle pin includes a threaded bolt portion, an intermediate portion of extended diameter for retaining the housing, and an exposed shackle portion having a grooved recess for retaining an associated padlock body, the shackle pins extending through holes in the rearward face of the housing and serving to mount the housing in fixed position.

11. The assembly of claim 1 wherein the slidable latch comprises a rod extending through holes in opposed ends of the housing and mounted for rotation and lateral movement relative to the housing.

12. The assembly of claim 11 wherein said lockout tab includes a handle portion for rotating the rod and moving it laterally relative to the housing.

13. The assembly of claim 12 wherein the lockout tab is generally L-shaped with a bottom portion having a pair of elongated holes adapted to encompass a pair of shackle pins when the lockout tab and rod are rotated into locking position.

14. The assembly of claim 13 wherein the lockout tab is selectively positioned on the rod and is so configured as to limit both the extent of rotation of the rod and the extent of lateral movement relative to the housing.

15. A locking assembly as claimed in claim 1, further comprising:

a backing plate for attachment of the assembly to a door; and wherein the slidable latch comprises a slide bar located between the backing plate and the housing;

wherein the housing is fixedly engagable to the backing plate and has a U-shaped cross section;

wherein the slide bar has a latching end and a blocking end at opposite portions thereof, the blocking end being perpendicularly inclined to the main body of the slide bar and comprising said lockout tab;

wherein the housing has an orifice therein; and wherein the blocking end of the slide bar is located to protrude through the orifice, whereby the slide bar may be moved between latched and unlatched positions by manual movement of the blocking end within the orifice.

16. Lock apparatus as defined in claim 15 which additionally comprises:

a first pair of shackles rigidly engaged to said backing plate at a position directly behind said orifice; and a primary lock adapted to engage said first pair of shackles whereby said lock may be inserted into said orifice to secure the blocking end of said slide bar in latching position.

17. Lock apparatus as defined in claim 16 which additionally comprises a pair of guards at opposite edges of said orifice to protect said primary lock.

18. Lock apparatus as defined in claim 15 which additionally comprises:

a pair of insertable shackles;

a pair of slots in said housing to retain said insertable shackles therein;

said insertable shackles each having a base portion which protrudes into the interior of the U-shaped cross-section of said housing when said shackle is retained in one of said slots of said housing;

said slide bar having a pair of apertures therein, said apertures so located as to admit the protruding base portion of an insertable shackle interior thereto and so dimensioned as to abut said insertable shackles at the portion thereof located to the latch end of said slide bar when said slide bar is in latching position; and a secondary lock to engage said insertable shackles whereby said slide bar is retained in said latching position.

19. Lock apparatus as defined in claim 15 wherein said backing plate is located at the opposite side of said door from said housing.

20. Lock apparatus as defined in claim 19 which additionally comprises a pair of spacers located interior of said U-shaped cross section of said housing to provide separation of said housing from said door.

21. Lock apparatus for engaging a door in latched relationship to a door frame, comprising:

a housing;

a first pair of shackle pins;

means for mounting the shackle pins in fixed position relative to said housing for engaging a removable padlock body in locking relationship thereon;

a slidable latching member supported on and movable relative to the housing between latched and unlatched positions without removal of said shackle pins, the member being engagable in a fixed position by the padlock body when the padlock body is mounted on the shackle pins in locking relationship; and guard means defining a recess for the padlock body in said locking relationship for blocking access to said shackle pins.

22. The apparatus of claim 21 wherein the slidable latching member is configured to be selectively engageable in a latched or unlatched position by the padlock body when the padlock body is mounted on the shackle pins.

23. The apparatus of claim 21 further comprising a second pair of shackle pins mounted in a fixed position offset from the first shackle pins in the direction of movement of the slidable latching member for blocking movement of the latching member in either direction between said latched and unlatched positions when a second padlock body is mounted thereon in locking relationship, independently of the presence of a padlock body on the first shackle pins.

24. The apparatus of claim 23 wherein the guard means further defines a recess for the second padlock body when in said locking relationship for blocking access to said second pair of shackle pins.

25. The apparatus of claim 21 further comprising means for mounting the shackle pins on a door member, said last-mentioned mounting means being locatable on the side of the door member remote from the side adjacent the housing.

* * * * *